US009947250B2

(12) United States Patent
Yang et al.

(10) Patent No.: US 9,947,250 B2
(45) Date of Patent: Apr. 17, 2018

(54) STANCHION CAPABLE OF PROVIDING PROMPTED INFORMATION

(71) Applicants: Yao Ming Yang, New Taipei (TW); Yuan Hsien Chien, Nantou County (TW); Ping-Kun Lin, Taipei (TW)

(72) Inventors: Yao Ming Yang, New Taipei (TW); Yuan Hsien Chien, Nantou County (TW); Ping-Kun Lin, Taipei (TW)

(73) Assignee: UNION PRECISION HARDWARE CO., LTD., Huizhou (CN)

( * ) Notice: Subject to any disclaimer, the term of this patent is extended or adjusted under 35 U.S.C. 154(b) by 0 days.

(21) Appl. No.: 15/194,896

(22) Filed: Jun. 28, 2016

(65) Prior Publication Data

US 2017/0032720 A1 Feb. 2, 2017

(30) Foreign Application Priority Data

Jul. 28, 2015 (TW) ..... 104212126 U

(51) Int. Cl.

| | |
|---|---|
| ***G08B 3/00*** | (2006.01) |
| ***G09F 27/00*** | (2006.01) |
| ***E01F 13/02*** | (2006.01) |
| ***G09F 13/22*** | (2006.01) |
| ***G09F 15/00*** | (2006.01) |

(52) U.S. Cl.

CPC ..... *G09F 27/005* (2013.01); *E01F 13/028* (2013.01); *G09F 13/22* (2013.01); *G09F 15/0037* (2013.01); *G09F 15/0056* (2013.01); *G09F 2013/222* (2013.01)

(58) Field of Classification Search

CPC ..... E01F 13/028; G09F 15/0037; G09F 15/0056; G09F 27/005

See application file for complete search history.

(56) References Cited

U.S. PATENT DOCUMENTS

2010/0288990 A1* 11/2010 McPherson ..... E01F 13/028 256/65.01
2012/0119907 A1* 5/2012 Teuchert ..... G08B 5/006 340/541
2016/0335929 A1* 11/2016 Meisels ..... G09F 7/00

* cited by examiner

*Primary Examiner* — Omeed Alizada

(57) ABSTRACT

A stanchion capable of providing prompted information comprises a post and a prompt device disposed in the post. The prompt device senses the queuing state and outputs the prompted information corresponding to the queuing state. Hence, the stanchion offers information favorable for the queue such as waiting time and other helpful functions available for being applied to prompt people in the queue as well in addition to partitioning the moving line of the queue.

12 Claims, 3 Drawing Sheets

STANCHION CAPABLE OF PROVIDING PROMPTED INFORMATION

CROSS-REFERENCE TO RELATED APPLICATIONS

The application claims priority from Taiwan Utility Model Application No. 104212126 filed on Jul. 28, 2015, the disclosure of which is incorporated herein by reference.

BACKGROUND OF THE INVENTION

1. Field of the Invention

The present invention is related to a stanchion, and particularly to a stanchion capable of providing prompted information.

2. Brief Description of the Related Art

Due to the lifestyle of human tending congregation and people participating activities getting enthusiastic, the stanchion becomes an important apparatus to maintain order in the modern life. The conventional stanchion usually has a post hanged with red velvet strips to partition a moving line of people in an open space so as to restrict so many persons attending an activity as a queue and keep an activity venue in order.

However, although the conventional stanchion can restrict people attending an activity as a queue and keep an activity venue in order, there is no information related to people in the queue offered or other functions helpful for them. Therefore, to improve the conventional stanchion is a subject worth us to investigate.

SUMMARY OF THE INVENTION

Accordingly, an object of the present invention is to provide a stanchion capable of providing prompted information with which not only moving line of a queue can be partitioned but also information helpful for people in the queue can be prompted.

Another object of the present invention is to provide a stanchion capable of providing prompted information with which a function of charging external mobile device is provided in addition to the moving line of a queue being partitioned.

A further object of the present invention is to provide a stanchion capable of providing prompted information with which a function of WiFi wireless repeater is provided in addition to the moving line of a queue being partitioned.

A further object of the present invention is to provide a stanchion capable of providing prompted information with which a function of moving line guide or emergency illumination light source is provided in addition to the moving line of a queue being partitioned.

In order to achieve the preceding objects and other objects, a stanchion capable of providing prompted information according to the present invention comprises a post and a prompt device; the prompt device is disposed in the post to sense queuing state and outputs prompted information corresponding to the queuing state.

In a preferred embodiment, the prompt device of the stanchion according the present invention comprises a sensor, an output unit and a control unit; the sensor senses the queuing state around the post; the control unit is coupled to the sensor and the output unit to receive the queuing state sensed by the sensor and send out the prompted information via the output unit.

In a preferred embodiment, the sensor of the prompt device of the stanchion according the present invention is an infrared sensor.

In a preferred embodiment, the prompt device of the stanchion according the present invention further comprises a transceiver unit which is coupled to the control unit to communicate with external servers or other stanchions.

In a preferred embodiment, the transceiver unit of the prompt device of the stanchion according the present invention is a WiFi wireless transceiver unit to transmit signals to the control unit which amplifies and forwards the signals to provide a function of repeater.

In a preferred embodiment, the prompt device of the stanchion according the present invention further comprises an illumination unit as a light source for illumination.

In a preferred embodiment, the prompt device of the stanchion according the present invention further comprises a chargeable battery and a charging-discharging unit coupled to the control unit and the chargeable battery to store electric energy and charge external mobile devices.

In a preferred embodiment, the prompt device of the stanchion according the present invention further comprises an input unit coupled to the control unit to reset an operation mode of the control unit.

In a preferred embodiment, the output unit of the prompt device in the stanchion according the present invention has a display panel to display the prompted information.

In a preferred embodiment, the output unit of the prompt device in the stanchion according the present invention has a voice generator to generate voice message standing for the prompted information.

In a preferred embodiment, the output unit of the prompt device in the stanchion according the present invention further comprises a flexible barrier belt selected from flexible panel or industrial fabrics.

In a preferred embodiment, the stanchion according the present invention further comprises a motor driving unit coupled to the control unit, which is disposed in the post and has a rotating shaft, and the flexible barrier belt is attached to the rotating shaft.

In summary, a stanchion capable of providing prompted information according to the present invention employs a prompt device disposed in a post to sense a queuing state and outputs prompted information corresponding to the queuing state. Therefore, information helpful for people waiting in the queue is offered in addition to partitioning the queue along a moving line.

BRIEF DESCRIPTION OF THE DRAWINGS

The detail structure, the applied principle, the function and the effectiveness of the present invention can be more fully understood with reference to following description and accompanying drawings, in which.

DETAILED DESCRIPTION OF THE INVENTION

Figure 1:
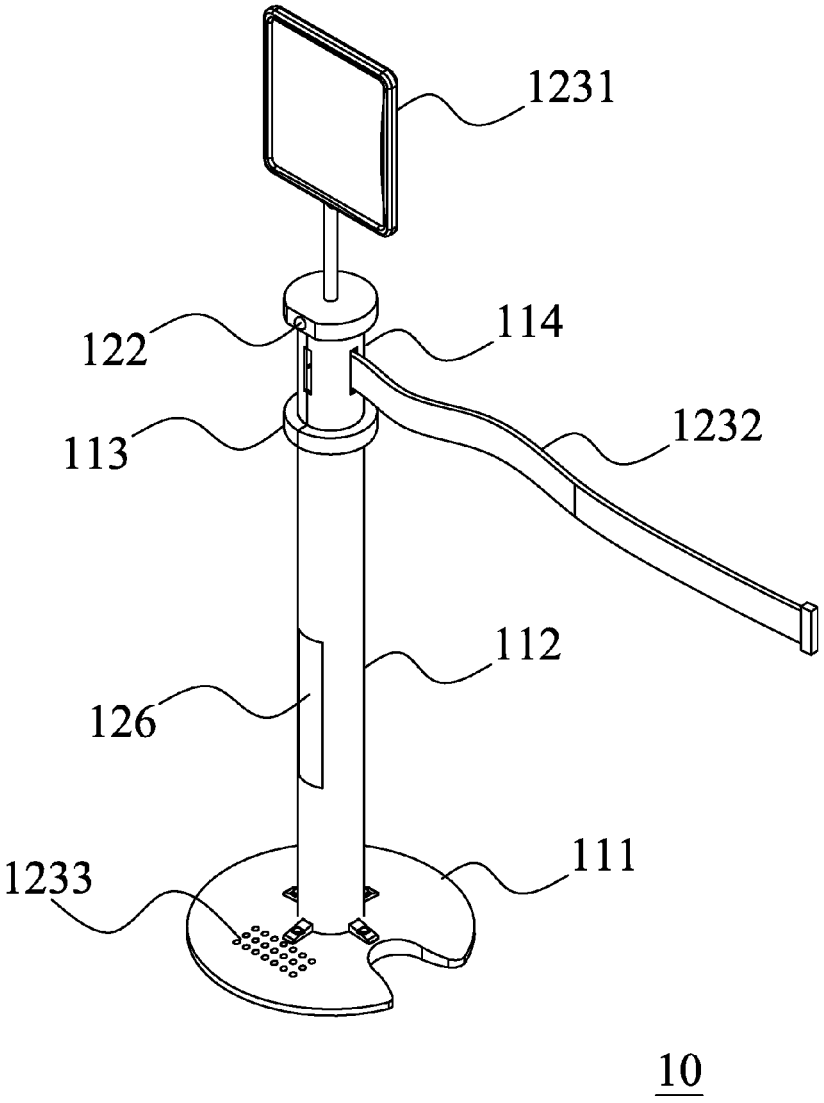
FIG. 1 is a perspective view of a preferred embodiment of a stanchion capable of providing prompted information according to the present invention.
Figure 2:
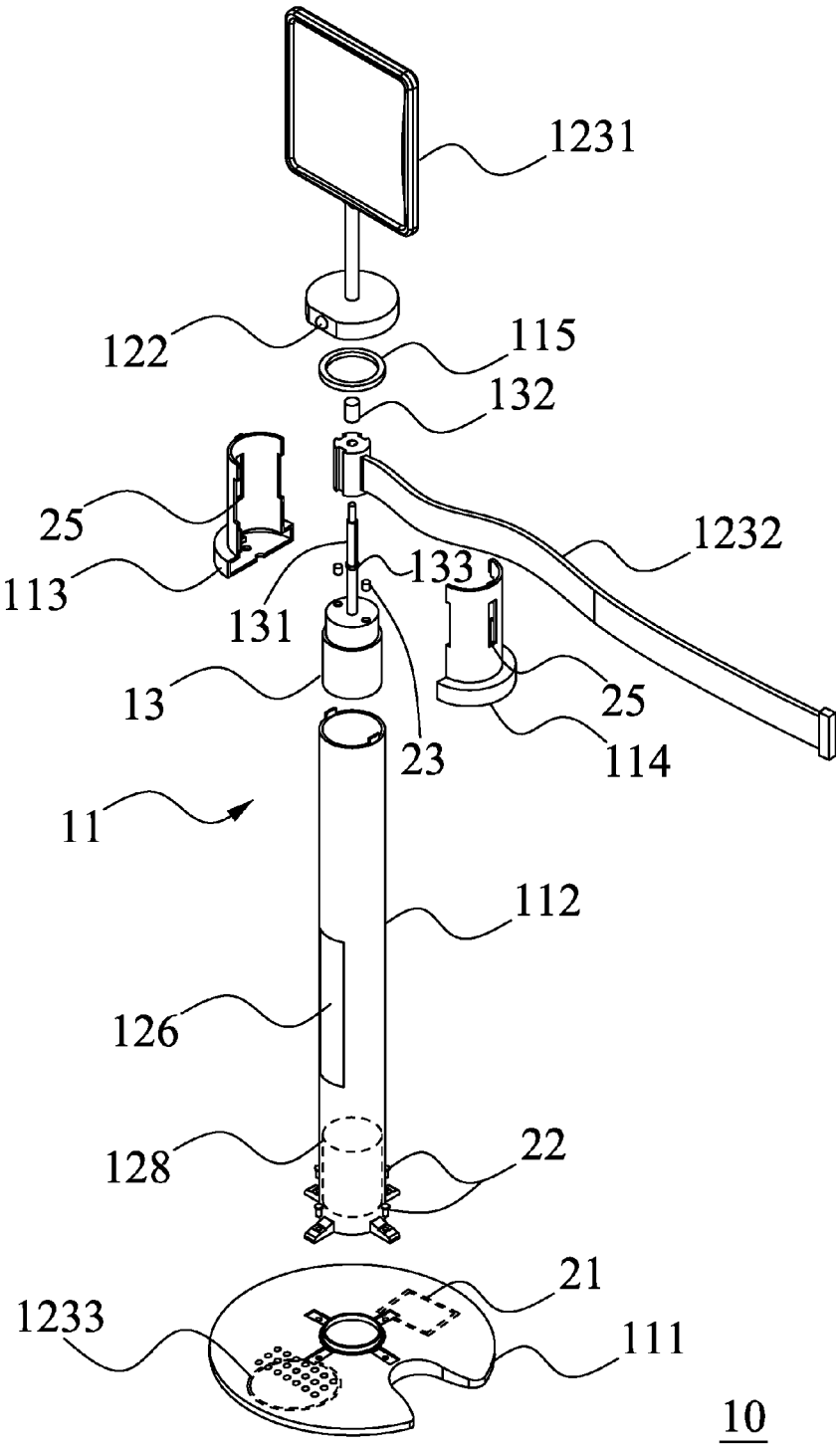
FIG. 2 is an exploded perspective view of the stanchion capable of providing prompted information shown in FIG. 1.
Figure 3:
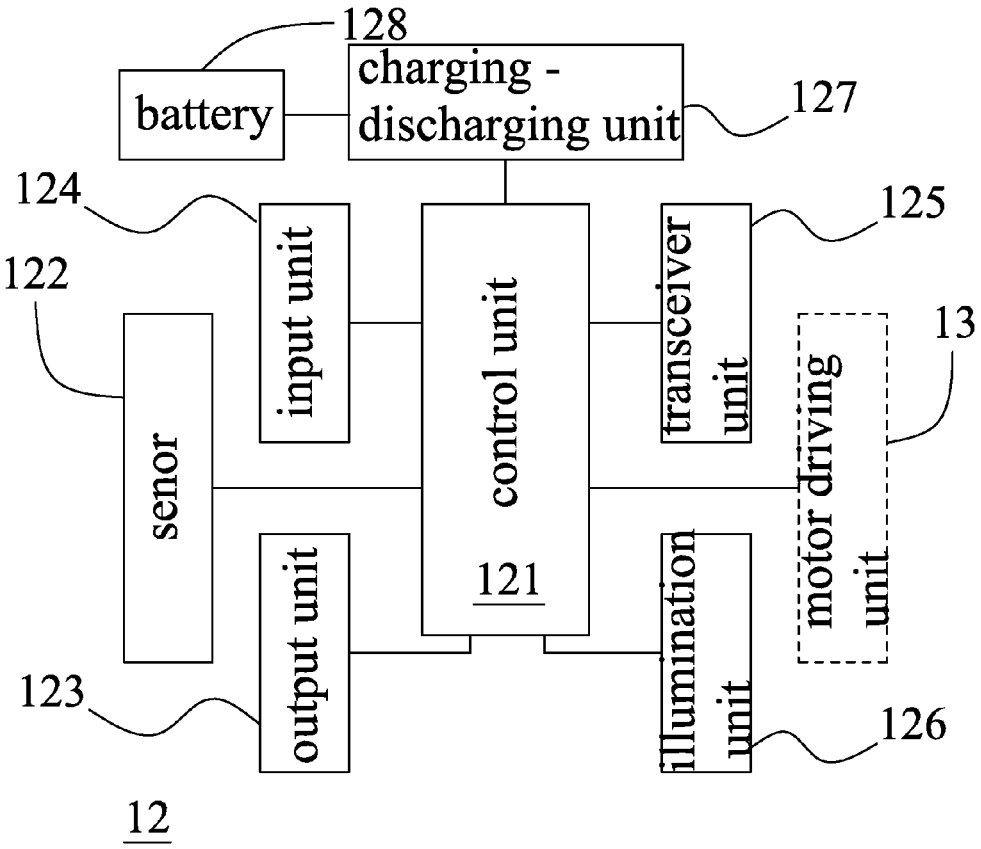
FIG. 3 is a block diagram of a prompt device employed in the stanchion capable of providing prompted information according to the present invention shown in FIG. 1.

Referring to FIGS. 1 and 2, perspective views of a preferred embodiment of a stanchion capable of providing prompted information according to the present invention and FIG. 3 showing a block diagram of a prompt device in the stanchion are illustrated. A stanchion 10 shown in FIGS. 1 and 2 comprises a post 11 and a prompt device 12; the prompt device 12 is arranged in the post 11 to sense a queuing state of a queue and output prompt messages base on the queuing state.

The post 11 comprises a base 111, a lower post part 112, a left upper post cover half 113, a right upper post cover half 114, and a top upper post cover part 115. The prompt device 12 shown in FIG. 3 comprises a control unit 121 which is couple to a sensor 122 such as infrared sensor or photography device, an output unit 123, an input unit 124, a transceiver unit 125, an illumination unit 126, and a charging-discharging unit 127, respectively, and a chargeable battery 128 which is coupled to the charging-discharging unit 127.

Wherein, the output unit 123 shown in FIG. 2 is a display panel 1231 and/or a flexible barrier belt 1232; the display panel 1231 is capable of displaying the prompted information or other information such as advertisements, guides and notices; the flexible barrier belt 1232 is selected from flexible panels or industrial fabrics; alternatively, the output unit 123 shown in FIG. 2 can be a voice generator 1233 which generates voice messages standing for the prompted information. Besides, in order to be capable of retracting the flexible barrier belt 1232 automatically, the stanchion 10 further comprises a motor driving unit 13 coupled to the control unit 121. Of course, for the skill in the art, it is known that a mechanical device with a spiral spring can be employed to retract the flexible panel 1232 instead of the motor driving unit 13.

Referring to FIG. 2 again, the base 111 contains the voice generator 1233 and a printed circuit board 21 which is integrated with the control unit 121, the input unit 124, the transceiver unit 125, and the charging-discharging unit 127; the base 111 has an indentation for being overlapped and stored easily. The chargeable battery 128 is received in the lower post part 112 before the lower post part 112 is engaged to the base 111 with screws 22. The illumination unit 126 such as light emitting diode is disposed at the lower post part 112 to guide people moving in the queue or as an emergency light source when necessary.

The motor driving unit 13 is fastened to bottoms of the left upper post cover half 113 and the right upper post cover half 114 with screws 23 after the left and right upper cover halves 113, 114 being engaged with each other; the flexible barrier belt 1232 nonrotatably fits with a rotating shaft 131 of the motor driving unit 13, and a retaining sleeve 132 is turned and fixed to the distal end of the rotating shaft 131 with an end of the flexible barrier belt 1232 fixedly pressing against a flange 133 on the rotating shaft 131 to prevent the flexible barrier belt 1232 from moving toward the distal end of the rotating shaft 131 and becoming loosening apart.

Afterwards, the motor driving unit 13 is disposed at the upper hollow end of the lower post part 112 with the engaged left and right upper post cover halves 113,114 being steadily retained above the lower post part 112; further, the top upper post cover part 115 is joined to the engaged left and right upper post cover halves 113, 114 and the display panel 1231 is joined to the top upper post cover part 115 to compete the assembly.

It can be seen in FIG. 2 that there are four openings 25 disposed at the circumferential side of the engaged left and right upper post cover halves 113, 114 equidistantly. One of the openings 25 is capable of being passed through by the flexible barrier belt 1232, and the other three openings 25 are available for being inserted with distal ends of other flexible barrier belts 1232 so as to be connected to other stanchions 10 selectively while a moving line layout being arranged. Thus, various moving line plans can be done conveniently.

When in use, the sensor 122 is capable of detecting the queuing state around the post 11 and sends detected result to the control unit 121 such that the prompt message such as waiting time with the current queue length can be output via the display panel 1231, flexible barrier belt 1232 and/or voice generator 1233 to allow people in the queue to predict how long they have to wait. Alternatively, the detected queuing state or the prompt message is transmitted to external server or other stanchions via the transceiver unit 125 such as WiFi wireless transceiver unit; further, when the control unit 121 amplifies and forwards signals received from the WiFi wireless transceiver unit 125 selectively, the stanchion 10 can provide a function of repeater as well.

Besides, the chargeable battery 128 disposed in the lower post part 112 performs power charging and energy storing with the charging-discharging unit 127 disposed in the base 111 except supplying the power required by the stanchion 10. The operation mode of the control unit 121 in the stanchion 10 can be reset via the input unit 124.

While the invention has been described with referencing to the preferred embodiment thereof, it is to be understood that modifications or variations may be easily made without departing from the spirit of this invention defined by the appended claims.

What is claimed is:

1. A stanchion capable of providing prompted information suitable for partitioning a queue along a moving line, comprising:

a post;

a prompt device which is arranged in the post to sense a queuing state of the queue and output said prompted information corresponding to the queuing state; and a motor driving unit disposed in said post and having a rotating shaft;

wherein said post further comprises:

a base containing a printed circuit board;

a lower post part having two hollow ends with one of said hollow ends engaging with said base;

two opposite upper post cover halves engaging with each other at the other hollow end of said lower post part with bottoms of said upper post cover halves being fastened to said motor driving unit; and a top upper post cover part disposed on said engaged left and right upper cover halves.

2. The stanchion as defined in claim 1, wherein said prompt device further comprises:

a sensor sensing the queuing state around the post;

an output unit;

a transceiver unit;

an illumination unit disposed at said lower post part;

a charging-discharging unit coupled with a chargeable battery disposed in said lower post part;

an input unit; and a control unit which is coupled to said sensor, said output unit, said transceiver unit, said illumination unit, said charging-discharging unit, said input unit, respectively, and further coupled to said motor driving unit so as to receive the queuing state sensed by said sensor and send out said prompted information via said output unit;

wherein said control unit, said input unit, said transceiver unit, and said charging-discharging unit are integrated with said printed circuit board.

3. The stanchion as defined in claim 2, wherein said sensor is an infrared sensor.

4. The stanchion as defined in claim 2, wherein said transceiver unit is to communicate with external servers or other stanchions which are capable of partitioning the same moving line of said queue.

5. The stanchion as defined in claim 2, wherein said transceiver unit is a WiFi wireless transceiver unit to transmit signals to said control unit, and said control unit amplifies and forwards the signals to provide a function of repeater.

6. The stanchion as defined in claim 2, wherein said illumination unit is a light source for illumination.

7. The stanchion as defined in claim 2, wherein said chargeable battery is disposed in said lower post part to perform power charging, storing electric energy and charging external mobile devices with said charging-discharging unit.

8. The stanchion as defined in claim 2, wherein said input unit is to reset operation modes of said control unit.

9. The stanchion as defined in claim 2, wherein said output unit has a display panel joined to said top upper post cover part to display said prompted information.

10. The stanchion as defined in claim 2, wherein said output unit has a voice generator contained in said base to generate voice message standing for said prompted information.

11. The stanchion as defined in claim 2, wherein said output unit further comprises a flexible barrier belt selected from flexible panels or industrial fabrics.

12. The stanchion as defined in claim 11, wherein said flexible barrier belt is attached to said rotating shaft.

* * * * *